United States Patent [19]

Camaioni

[11] 4,067,255

[45] Jan. 10, 1978

[54] RETRACTABLE GUITAR PICK

[76] Inventor: Ron Camaioni, 17778 Foothill, Fontana, Calif. 92335

[21] Appl. No.: 748,051

[22] Filed: Dec. 6, 1976

[51] Int. Cl.[2] ..... G10D 3/16

[52] U.S. Cl. ..... 84/322; 84/329; 242/107.6

[58] Field of Search ..... 84/320–322, 84/329, 453; 242/107–107.7

[56] References Cited

U.S. PATENT DOCUMENTS

| | | | |
|---|---|---|---|
| Re. 4,419 | 6/1871 | Bradley | 242/107.6 |
| 2,528,663 | 11/1950 | Mitchell | 84/320 X |
| 2,632,609 | 3/1953 | Kirby | 242/107.6 |

*Primary Examiner*—Lawrence R. Franklin

[57] ABSTRACT

A retractable guitar pick used in combination with a guitar, wherein the present device is mounted to the housing thereof similarly to the control knobs now located thereon. The retractable guitar pick comprises a housing mounted to the body of the guitar adjacent existing controls so as not to interfere with the playing of the strings thereof. A retractable cable is disposed in the housing wherein there is a lock button to hold or release the cable having a typical guitar pick attached to the free end thereof. The cable is attached to a take-up spring which is held in various positions, to allow the pick to reach any location along the guitar to strike the strings thereof.

6 Claims, 5 Drawing Figures

RETRACTABLE GUITAR PICK

BACKGROUND OF THE INVENTION

1. Field of the Invention

This invention relates generally to a pick for playing a musical instrument and, more particularly, to a guitar pick attached to a retractable device which is mounted to the body of a guitar.

2. Description of the Prior Art

As is well known in the art of music, various problems and difficulties are encountered in providing a player of a musical instrument, having need for a pick, a suitable device whereby the pick can not be lost, either during the use thereof or misplacing the pick after use thereof.

Since guitar picks in themselves are small and very thin, they can be readily lost or overlooked when one wants to play a guitar. Often, a pick can be dropped and, because of the configuration and color, can become very difficult to find.

Thus, a problem occurs when a player inadvertently drops his pick during the playing of a number and must stop to find it.

Accordingly, the present invention which is hereinafter disclosed will overcome such problems.

SUMMARY OF THE INVENTION

The present invention comprises a retractable guitar pick having a typical pick attached to the free end of a cable, the cable being releasably disposed in a housing. The releasable means comprises a drum rotatably mounted in the housing and held in place by a locking mechanism which is released by a lock button.

Retractable tension is provided by a take-up spring which is also controlled by the locking mechanism, which allows the cable to be extended for use and retracted only when released by pressing the locking button to disengage the locking mechanism, the drum and the spring.

Accordingly, if one drops the pick it can not be lost as it is always connected to the cable. When not in use, the cable is retracted into its housing, which is secured to the body of the guitar; and thus the pick is always found adjacent the housing thereof.

OBJECTS AND ADVANTAGES OF THE INVENTION

The present invention has for an important object a provision wherein a guitar pick is always movably attached to a guitar; that is, it is releasably mounted by a cable and housing to the body of a guitar.

It is another object of the invention to provide a retractable guitar pick of this character wherein it is easily adjustable to any player; and can be extended to any portion of the guitar strings without interference to the player.

It is still another object of the invention to provide a retractable guitar pick that is easy to use and simple to attach to any guitar.

It is a further object of the present invention to provide a guitar pick of this character wherein the housing is attached to an electric guitar adjacent the controls therefor, so as not to be conspicuous thereon.

It is still a further object of the invention to provide a device of this character that will prevent the inadvertent misplacing of a guitar pick.

Still another object of the invention is to provide a device of this character that is relatively inexpensive to manufacture, yet simple and rugged in construction.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or modes of operation that are properly within the scope of the appended claims.

DESCRIPTION OF THE DRAWINGS

Referring more particularly to the accompanying drawings, which are for illustrative purposes only.

DESCRIPTION OF THE PREFERRED EMBODIMENT

Figure 1:
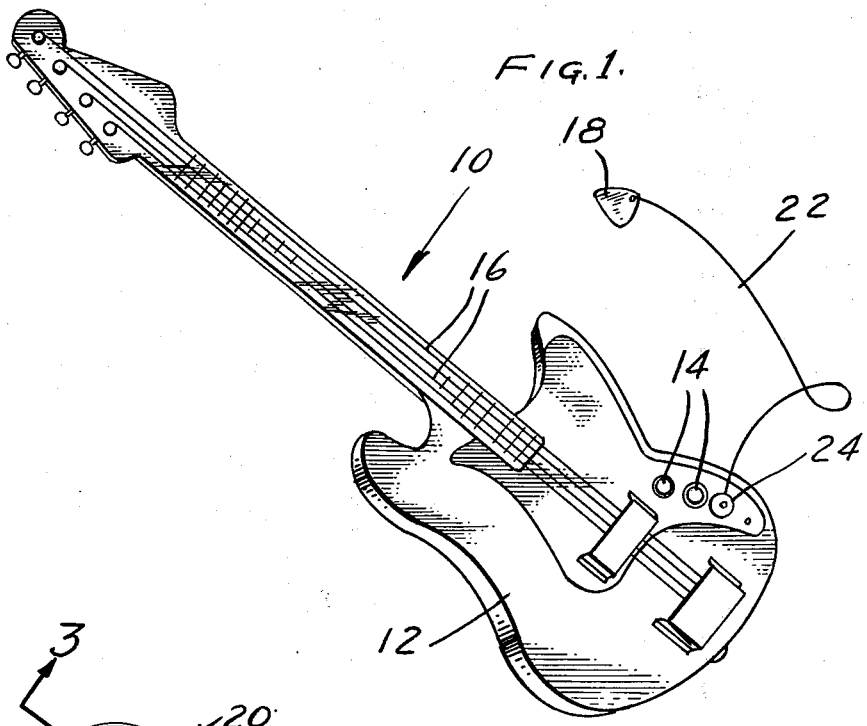
FIG. 1 is a pictorial view of a typical electrical guitar wherein the present invention is attached thereto.

Referring more particularly to FIG. 1, there is shown an electrical guitar generally indicated at 10, having a main body 12 of the well-known, typical construction, wherein various control knobs 14 are mounted thereon.

Figure 2:
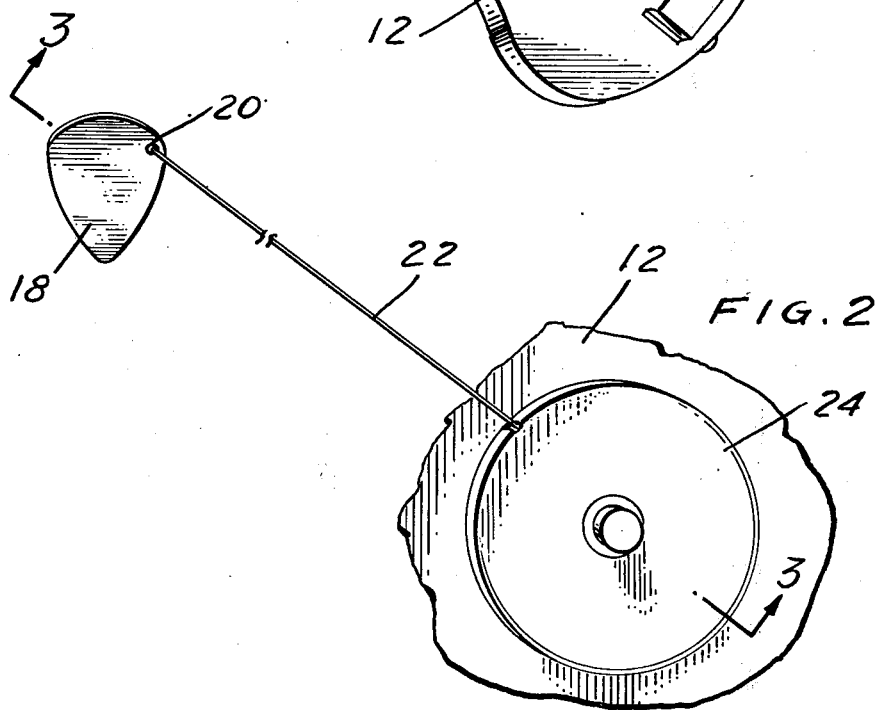
FIG. 2 is a top plan view of the present invention, showing the attached pick extended from the housing thereof.
Figure 3:
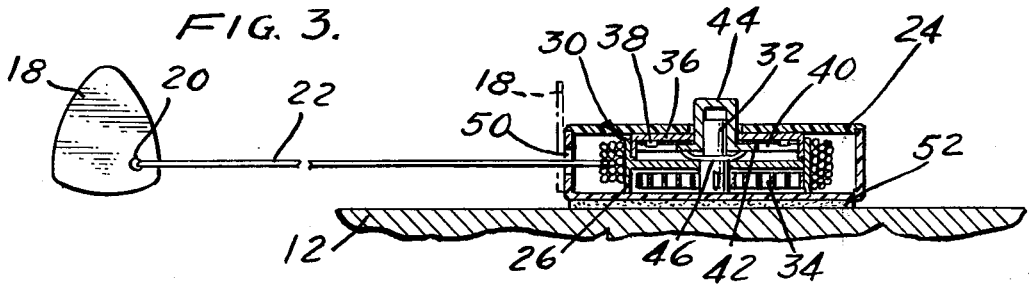
FIG. 3 is a cross-sectional view taken substantially along line 3—3 of FIG. 2, and wherein the pick is shown in phantom lines in a retracted position.

As is well understood in the art, musical strings 16 are positioned longitudinally thereon so as to be struck by a pick, which is designated by numeral 18. Said pick 18 is shown in FIGS. 1 through 3 as being provided with an aperture 20 to which the free end of a cable or line 22 is attached, the cable being of any suitable material, such as a nylon cord.

The cable is releasably disposed in a housing 24 having a generally circular configuration, whereby said housing can simulate said control knobs 14. Thus, it is contemplated that housing 24 will be mounted adjacent said knobs 14, as seen in FIG. 1. Cable 22 is wrapped around the peripheral wall 26 of the rotatable drum, generally indicated at 30, the drum being rotatably mounted to a centrally fixed pin 32. The pin 32 is connected to said drum through a take-up, coil spring 34, which creates the retractable force necessary to retrieve cable 22 within housing 24.

However, there is included therein a locking means which controls the retracting of said cable, said retracting means comprising a top wall 36 secured to peripheral wall 26 of drum 30 having depending engagement tabs 38, which are arranged to be received in slots 40 of the annular flange 42 of the release button 44.

Accordingly, button 42 is only allowed to move up and down on pin 32. Button 42 is constantly biased upwardly by a ring spring 46 which prevents rotation thereof. Thus, as button 44 is pressed downwardly against spring 46, tabs 38 are disengaged from slots 40 whereby drum 30 is rotated by take-up spring 34, at which time pick 18 is retracted along with the cable 22. The cable passes through hole 50 of said housing; and pick 18 comes to rest against the housing, as seen in FIG. 3.

The arrangement, therefore, allows the pick 18 to be extended to any length given to cable 22 at any time, and will be held or locked to that length until release button 44 is pressed.

It should also be understood that said device can be adopted for use with any musical instrument that requires a pick to be employed when playing. Therefore, the mounting of housing 24 can be by any suitable means, but is herein shown as being attached to body 12 by an adhesive material 52, as seen in FIG. 3.

The invention and its attendant advantages will be understood from the foregoing description and it will be apparent that various changes may be made in the form, construction and arrangement of the parts of the invention without departing from the spirit and scope thereof or sacrificing its material advantages, the arrangement herein before described being merely by way of example, and I do not wish to be restricted to the specific form shown or uses mentioned, except as defined in the accompanying claims.

I claim:

1. A retractable guitar pick device in combination with a guitar having a main body portion to which said device is mounted thereto, wherein said device comprises:

a guitar pick having an aperture disposed therein;

an elongated cable attached to said pick through said hole;

a circular housing having a hole therein to receive said cable therethrough;

retracting means concentrically arranged within said housing, whereby said cable is attached thereto;

a releasable locking means mounted within said retracting means;

a central pin affixed to and positioned in said housing to rotatably receive thereon said retracting means; and a take-up spring connected between said retracting means and said central pin.

2. A retractable guitar pick device in combination as recited in claim 1, wherein said retracting means comprises:

a drum rotatably mounted to said central pin having an annular wall wherein said cable is wrapped thereon;

a top wall secured to said annular wall, said top wall having a central hole disposed therein.

3. A retractable guitar pick device in combination as recited in claim 2, wherein said releasable locking means comprises:

a button extending through said top wall and said housing, and having an annular flange member wherein a plurality of radial slots are disposed therein, said button being slidably supported on said pin;

a plurality of depending tabs mounted to said top wall for engagement with said slots of said flange member; and a spring biasing means forcing said button upwardly in engagement with said top wall of said drum.

4. A retractable guitar pick device in combination as recited in claim 3, including means for securing said housing to said main body portion of said guitar.

5. A retractable guitar pick device in combination as recited in claim 4, wherein said securing means comprises an adhesive pad positioned between said housing and said guitar body.

6. A retractable guitar pick device in combination as recited in claim 4, wherein said guitar is the electrical type having a plurality of control knobs mounted to said main body; and wherein said housing of said device comprises a configuration like that of said control knobs.

* * * * *